United States Patent [19]

Jurrus

[11] Patent Number: 4,844,964

[45] Date of Patent: Jul. 4, 1989

[54] SIGNBOARD UNITS AND PROCESS FOR MAKING SAME

[76] Inventor: Carl E. Jurrus, 115 Levan Dr., Painesville, Ohio 44077

[21] Appl. No.: 166,113

[22] Filed: Mar. 10, 1988

[51] Int. Cl.[4] ..... G09F 7/20

[52] U.S. Cl. ..... 428/74; 428/703; 428/251; 40/584

[58] Field of Search ..... 428/70, 701, 74, 251, 428/703; 40/125

[56] References Cited

U.S. PATENT DOCUMENTS

| | | |
|---|---|---|
| 306,462 | 10/1884 | Baxter . |
| 1,204,613 | 11/1916 | Thomas . |
| 1,675,580 | 7/1928 | Severns et al. . |
| 3,186,118 | 6/1965 | Smith . |
| 3,373,517 | 3/1968 | Halpern . |
| 3,538,036 | 11/1970 | Peters et al. . |
| 3,645,961 | 2/1972 | Goldfein . |
| 3,704,535 | 12/1972 | Penton et al. . |
| 3,826,663 | 7/1974 | Minicozzi et al. . |
| 4,039,345 | 8/1977 | Emig et al. . |
| 4,082,563 | 4/1978 | Ellis et al. . |
| 4,398,957 | 8/1983 | Ceska et al. . |
| 4,414,031 | 11/1983 | Studinka et al. . |
| 4,473,406 | 9/1984 | Bradley et al. . |
| 4,482,382 | 11/1984 | Kanayama et al. . |

OTHER PUBLICATIONS

Product Data revised 7-15-86, Cretelox TM Acrylic Integral Bonding Agent-Chem-Masters Corp., Chagrin Falls, Ohio, 3 pages.

Products for Concrete and Masonry 03010/CHE, Jan. 1987, BuyLine 0384 (cover and p. 4) Chem-Masters Corp., Chagrin Falls, Ohio.

*Primary Examiner*—Nancy A. B. Swisher

*Attorney, Agent, or Firm*—Watts, Hoffmann, Fisher & Heinke Co.

[57] ABSTRACT

A laminated signboard comprises a backing member overlaid with an attached reenforcing network into which a layer of polymer-fortified concrete is interlocked for bearing three dimensional indicia. The indicia is carved into the set up, but not practically hardened concrete. Usually, the concrete surface including the indicia is coated with a weather-resistant coating, and at least part of the indicia is coated to contrast with the remainder of the surface.

9 Claims, 1 Drawing Sheet

SIGNBOARD UNITS AND PROCESS FOR MAKING SAME

TECHNICAL FIELD

This invention relates to the construction of signboards and units therefor, and more particularly lightweight rigid ones having indicia integral therewith.

BACKGROUND ART

Heretofore picture frames, signboards, building plaques and the like have been made using plaster, mortar, portland cement concrete, and sheets of synthetic resin. Some have hollow, honeycomb-type or foamed polymer core structures. U.S. Pat. Nos. illustrating such articles include: 306,462; 1,204,613; 1,675,580; 3,186,118; 3,373,517; and 3,704,535. In general they lack some desirable feature such as longevity, freedom from maintenance, durability especially against stress cracking, low unit weight, and a wide variety of design options as to structure, shape, color, size, indicia, or expression of artistry. The present invention brings to the sign market a capability to have all of these desirable features at a reasonable cost.

Polymer-fortified concretes containing portland cement, compounded aqueous synthetic resin latex emulsion, aggregate, and water have been proposed as a dry set hydraulic cement for tiles, for improving the flow of cement and mortar pastes, particularly those containing lime, for water control, bonding and repairing to other materials such as concrete substrates, for blister-resistance, and for shrinkage compensation and resulting freeze thaw durability in expansive aluminate-type cement compositions. By a polymer-fortified concrete here is meant one compounded with such aqueous latex, portland cement, comparatively fine aggregate such as sand, and usually some water to supplement the aqueous latex.

However, the special advantages of using polymer-fortified portland cement concretes for making signboards (particularly concretes containing type 1 non-air entraining cement and no added lime) has not heretofore been recognized, and neither has incising the sign indicia into the set up, but not yet practically cured or hardened concrete sign surface. The polymer fortification of the concrete sign gives it good strength, dimensional stability, and weather tightness in comparatively thin sections, even one having substantial surface area (e.g. 6–10+ feet across).

DISCLOSURE OF THE INVENTION

One aspect of the invention is a laminated signboard unit comprising a backing member overlaid with an attached reenforcing network into which a layer of polymer-fortified concrete is interlocked. The polymer-fortified concrete is the substrate into which the indicia is cut. The concrete also can be coated with a finishing coat such as an aqueous latex finish for stucco to provide many options of color and texture.

A further aspect of the invention is a process of making the signboard unit which comprises: fastening a reenforcing network to a backing member; overlaying the network with an interlocking layer of polymer-fortified concrete; allowing the concrete to set up; cutting the surface of the set up concrete to leave indicia therein before the practical hardening of the concrete occurs: then completing the practical hardening of the concrete.

BEST MODE FOR CARRYING OUT THE INVENTION

Figure 1:
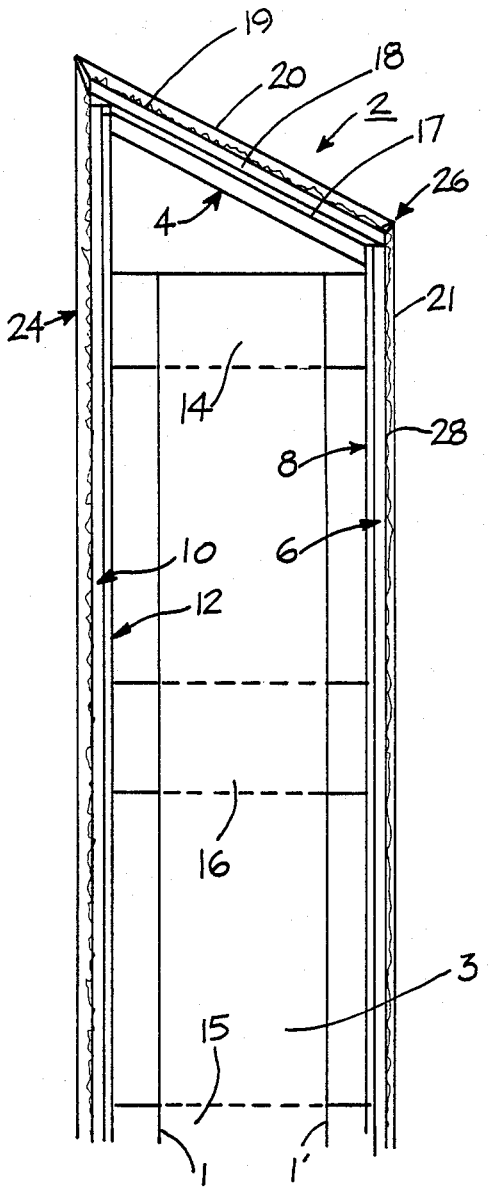
FIG. 1 is a fragmentary cross sectional side elevation view of a free-standing lawn sign.

The free-standing lawn sign 2 of FIG. 1 stands on polyvinyl chloride pipe posts indicated as 1 and 1'; the bottom of the sign reaches ground level, and the bottoms of the posts are not shown. The bottoms of posts are encased in concrete and extend into the ground to below the frost line; the posts are braced at about ground level with a wooden or metal bar, not shown. The upper part of such a post is the polymer pipe shown as items 1 and 1'. Bolted to the posts are 2"×4" horizontal wood frame members partially encased in galvanized steel studs 14, 15 and 16 to maintain true alignment of the encased wooden members. The latter are treated with wood preservative.

The front face of the sign is a laminated unit of: ¼" exterior grade plywood sheet 12 fastened to horizontal frame members 14, 15 and 16; 3/16" thick essentially all closed cell flexible foamed polymeric sheet 10 alternatively a heavy tar paper about 1/16" thick or thin polyethylene film) stapled to the plywood sheet 12 over its whole area; a layer of galvanized metal lath and fiberglass mesh covering the foamed polymeric sheet 10 and screwed, nailed and stapled to the horizontal frame members 14, 15 and 16; and a ½"–1", typically a ⅝" coating of acrylic polymer latex-fortified concrete 24.

The top and rear of the sign are laminated units of: ¼" exterior grade plywood sheets 17 and 8, respectively; 3/16" thick flexible foamed polymeric sheets 18 and 6, respectively; layers 19 and 28 of metal lath and fiberglass mesh fastened over the foamed polymeric sheets 18 and 6, respectively; and a ⅛"–1", typically a ½" coating of the same acrylic polymer-fortified concrete, items 20 and 21, described in connection with FIG. 1. The sides and bottom, not shown, have the same construction. All the fastenings are like those of the front face unit.

Polyvinyl chloride plastic corner bead 26 is disposed to protrude from the joint between foamed polymeric sheets 18 and 6 and is fastened to the plywood sheets 17 and 8 thereunder with staples or screws to form a concrete thickness guide at that corner. Like outside corners (not shown) are made in this manner at each like plywood joint to form the rest of the concrete thickness guides at the exterior corners. The corners are covered with overlapping fiberglass mesh. Wooden frame 4 fits between the plywood sheets 12 and 8 immediately below the plywood sheet 17 to provide support to the top of the sign.

The layer of polymer-fortified concrete is a plastic mixture of Type 1 (non-air entraining) portland cement and aggregate (354 parts of portland cement, 354 parts of sand) mixed with 146 parts of water, and 146 parts of a compounded acrylic latex concrete fortifier and bonding agent (Cretelox TM emulsion, the trademark of Chem-Masters Corp., Chagrin Falls, Ohio, 44022; it has weight per gallon of 8.86 pounds and 30% by weight latex solids content). The polymer-fortified concrete is applied to the reenforcing network of metal lath and fiberglass mesh to interlock therewith and make ordinarily a smooth exterior finish (apart from any indicia later cut in). However, this finish can be made to be textured or patterned in various conventional ways if desired. The concrete layer covers the entire exterior of the sign including a very thin layer over the corner beads. The indicia is applied later.

At ordinary room temperature of 25° C. this polymer-fortified concrete sets up in about 24–30 hours. It still can be scratched with a sharp stick. In this condition it has no apparent sag, flow or slump under its own weight (is "set up") although curing (i.e., hardening) continues for a much longer time thereafter to a practical hardening for handling and thereafter to ultimate hardening. When the concrete is set up, but still has not reached a practical hardness for handling, the indicia is carved ⅛" to ½" deep into the front face by a carbide—tipped end miller or router. The signboard then is stored at room temperature until it reaches practical hardness for handling.

Usually prior to carving the indicia, but afterwards if more convenient, the entire concrete surface is sprayed (or trowelled) with a thin coating of the acrylic stucco finish (brown-grey in this instance) R-Wall Finish, a product of ISPO Inc., Mansfield, Mass. 02048.

Alternatively one can use for the exterior finish the Cretelox emulsion with added sand or grit for texture, or use an aqueous dispersion of Medusa TM White Waterproof Cement, a product of the Medusa Portland Cement Company, Cleveland, Ohio, or Duration TM, liquid finish of Republic Powdered Metals, Inc., Medina, Ohio. Most of these finish coatings or paints are available in various colors and textures; a sand texture is preferred. They are used to decorate, hide and cover; a 1/10" or less thickness is adequate.

The base of the incised lettering often is painted with a contrasting (in this case, gold color) sand finish acrylic latex paint for masonry, specifically Thorocoat TM made by Thoro System Products, 7800 N.W. 38th St., Miami, Fla. 331166. The sign is very durable out in the weather and very resistant to cracking.

Figure 2:
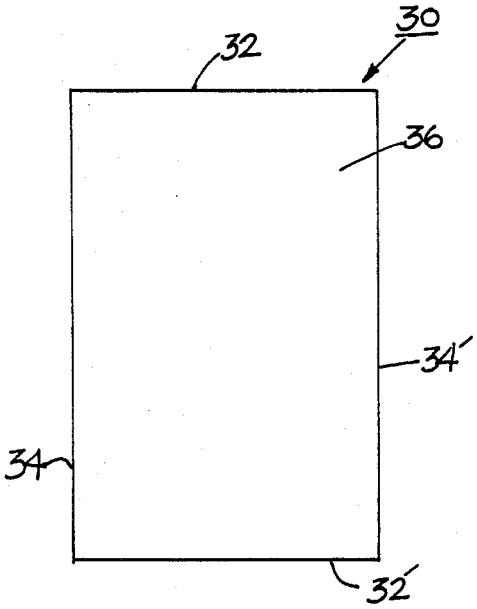
FIG. 2 is the front elevation of a wall signboard unit without indicia; and, FIG. 3 is a cross sectional side elevation of the wall sign of FIG. 2.

FIG. 2 shows the front 36 of a wall signboard unit nominated 30 and having no indicia yet incised thereon. The front 36, back (not shown), sides 34 and 34', top 32 and bottom 32' of the sign are covered completely with an uninterrupted smooth surface layer of polymer-fortified concrete having no edge beading. The shape of the sign is achieved by pouring the concrete into a form of appropriate dimensions as one would use for pouring a concrete slab, the mesh-covered backing member core being positioned within the form. There is no finish coat or indicia applied as yet; the finish coat and coloring of the indicia can be done as described in connection with FIG. 1.

The wall sign unit can be emplaced by fastening metal lath to the wall or other bearing surface, coating that lath and the rear of the signboard unit with more of the polymer-fortified concrete and bracing the unit against the bearing surface for at least 48 hours where these coatings join to achieve a practical cure. The edges of the sign at the bearing surface then are caulked with conventional exterior silicone caulking compound for window frames or the like. Polymer-fortified concrete for the sign body and the adhesion to the bearing surface here can be the same as that used for the signboard described for FIG. 1 although a thinner mixture often is preferred for the adhesion work. Alternatively, various other exterior adhesives can be used for sign attachment to walls, e.g., conventional polymer emulsion adhesives, epoxy adhesives, etc.

Figure 3:
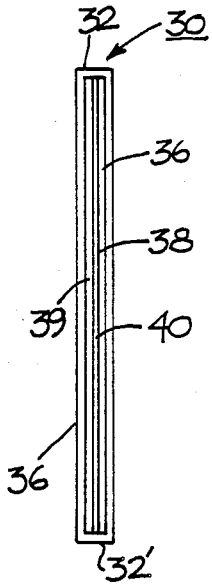

In FIG. 3 the wall signboard 30, covered overall with a continuous smooth layer of polymer-fortified concrete 36, has the front which is item 36 depicted in FIG. 2. The front (left) surface concrete layer is ⅝" thick; the top, bottom and rear (right) surface layers are ½" thick. The interiors of these layers are interlocked into a reenforcing mesh layer, not shown, that totally envelopes the core structure. The reenforcing mesh layer is metal lath and glass fiber mesh, attached with screws, staples and wire to plywood sheet 40. Rigid foamed (¾-1") polystyrene boards 38 and 39 are stapled to ¼" exterior plywood sheet 40. Finishing of the exterior of the concrete layer and a way to incise indicia into it have been described above in connection with FIG. 1.

The composition of the polymer-fortified concrete when fresh should provide a workable, soft plastic mixture that can be applied by conventional means to and interlock with the reenforcing mesh layer, e.g., by trowel. Advantageously the fresh polymer-fortified concrete is a mixture of about 20–50 parts type 1 non-air-entraining portland cement, 20–50 parts sand and/or other fine mineral aggregate, 10–20 parts of aqueous compounded latex such as Cretelox TM Brand integral bonding agent, and 10–20 parts of water, the parts being parts by weight. A preferred mixture is set forth in connection with the description of FIG. 1. For additional reenforcing and resistance to cracking one can include about 1–15% by weight of short (e.g. ¼"–¾") synthetic fibers in the polymer-fortified concrete. Use of particular fibers in concretes is shown in U.S. Pat. Nos. 3,645,961, 4,608,086, 4,693,749, and those teachings are incorporated herein by reference. Polyolefin, polyacrylonitrile, and titanate-coated aramid fibers are useful.

The aggregate used can impart to the polymer-fortified concrete some or all of its color. Usually the aggregate is fairly fine, typically 8 to 20 mesh (U.S. Std. Seive size) sand or finer silica; fly ash, pulverized expanded perlite or exfoliated vermiculite, pigmentary titanium dioxide, mica, talc, wollastenite, carbon black, and/or other mineral filler commonly used in paint also can be used as aggregate. Powdery solid colorants can be added as part of the aggregate, if desired.

The preferred synthetic polymers for formulating the polymer-fortified concrete and the finishing coating are aqueous emulsions of polymers that contain acrylate units. By an acrylate unit is meant acrylic or methacrylic acid and esters thereof, generally those of $C_{1-8}$ alkanols and hydroxylated $C_{1-4}$ alkanols. The suitable aqueous latex emulsions generally are compounded to be film-forming at ordinary room temperature. They can have protective colloids, plasticizers, coalescing agents, wetting agents and buffer salts conventionally used in concentrations customary for latices prepared by emulsion polymerization. The latices can include those containing some hydroxyacrylate units, butadiene-styrene copolymers, ethylenevinyl acetate copolymers, acrylamide-containing polymers, epoxy modified emulsion polymers, polyvinyl chloride, and/or neoprene elastomers to provide, advantageously, a polymer solids content of about 3–20% and preferably about 5.5–15% based on the weight of the dry portion (e.g., cement and sand) of the polymer-fortified concrete mix; the finishing coatings can be even richer in polymer solids, e.g., about 10–40+% based on the total weight of such aqueous coating. Typical latices here will have about 25–50% by weight solids content and can include suspended texturing agents such as silica, conventional wetting agents, pigmentation, and thixotropic agents such as hydroxypropylcellulose. The polymer content in the fortified concrete mix preferably is generally higher than that ordinarily used simply for flow improvement, bonding repair, etc.

A type 1 portland cement is preferred to make the superior sign of this type because it is not air-entraining. Also important for the durability and weather resistance of the present sign is the absence of any added lime, that is quicklime or slaked lime.

The set up (non sagging) but not practically hardened concrete can be incised to give indicia (such as letters) in relief or incised to give indicia in intaglio form or in bas relief. For example the letter "L" can be cut straight or obliquely into the concrete surface; or the surface around the "L" can be cut away in some pattern, e.g. an oval, to leave the letter standing full height inside the pattern; or the such standing letter can be sculpted artistically for special shadow or other effects in the oval. All this should be done if possible before practical hardness of the concrete develops.

While the beads at the corners for gauging concrete depth generally are of polyvinyl chloride polymeric plastic, they also can be made of zinc or other non-rusting metal. The preferred backing member for the signboard unit is exterior or marine plywood to which a foamed or other lightweight weather-resistant member such as rigid polystyrene board or flexible polymeric (e.g., polyolefin) foam, polyethylene film, or thick (1/16) tar paper is fastened onto one or both sides depending upon whether the unit is to be in a box-like structure or a wall sign. Foamed members are best closed cell for weather tightness. Other plywoods can be used, as can flakeboard, Masonite TM board, chipboard, Upson board, impregnated or plain bagasse board, and, in general, like construction boards. Preferably the board is flat and imperforate, but it can have fair sized holes in it, if desired. Preferably the foam member is flat or flattenable by virtue of its flexibility, but it can be textured or arcuate in form if desired. This waterproof cover member (or film or tar paper) usually is attached to the plywood with staples, but adhesives, nails, wire and other conventional fastenings also are possible. A foam member preferably is of polyolefin for economy and efficiency, but ureaformaldehyde, polyurethane, and other conventional polymeric foams also are useful.

Metal lath typically is an expanded slit sheet of steel, advantageously self-furring, although other types can be used. Virtually any metal sheet, strip or wire that is formed to give a mesh or other foraminous conformation that will accept the polymer-fortified concrete surface layer and interlock with it upon its hardening is useful. Adding to this lath a fiber mesh sheet (e.g. of glass fiber) and fastening the mesh and the lath directly over the backing unit (and preferably to frame members) mechanically provides an economical and durable substrate surface for interlocking with the of polymer-fortified concrete. Other mesh-like or screen-like materials, e.g., of polyolefin or acrylic fiber, also are useful here.

The signs can also be designed to border, partially border, or frame a message board, a picture or the like. With the freedom to use a multiplicity of colors in the polymer-fortified concrete and in the finishing coating over that concrete, in addition to texturizing exposed surfaces, incorporating reflective and/or refractive materials onto or into the finished surface (such as traffic paint beads), or compounding the surface of the finishing material with pearlescent frit-like particles, etc., there are almost unlimited design options. Colors can be earth-tone, bright, fluorescent, pastel, etc.

Sign posts are placed in holes typically 18" in diameter and 36" deep, then generally a concrete foundation is poured. The posts can be made of a polymer, or metal such as steel or galvanized steel, or reenforced concrete or the like. The sign usually appears then to be a solid masonry unit mounted on the foundation. The signs can be resurfaced and have new characters inscribed later, if needed. Attractive endurance is a main purpose of this comparatively lightweight structure.

Many other modifications and variations of the invention will be apparent to those skilled in the art in the light of the foregoing disclosure and drawings. Therefore, it is to be understood that, within the scope of the appended claims, the invention can be practiced otherwise than has specifically been shown and described.

I claim:

1. A laminated signboard unit comprising a backing member having a base, a mesh-like reinforcing network that is attached to and overlays the backing member, and a surface layer of polymer-fortified portland cement concrete that is not substantially thicker than about an inch, the surface layer being interlocked with said network, the base of the backing member being a solid or hollow structure consisting essentially of construction board.

2. The signboard unit of claim 1 bearing indicia that was cut into the concrete prior to the practical hardening thereof, and the concrete is made with type 1 portland cement with no added lime.

3. The signboard unit of claim 1 wherein the backing member consists essentially of constructon board faced with a waterproof cover, and the polymer-fortified portland cement concrete is characterized as a mortar.

4. The signboard unit of claim 1 wherein all exterior sides of the backing member are overlaid with an attached reenforcing network into which a layer of polymer-fortified concrete is interlocked.

5. The signboard of claim 1 wherein the backing member is a box-like structure that is internally reinforced for rigidity.

6. The signboard of claim 5 wherein there are corrosion-resistant beads rising from the outside corners of the backing members.

7. The signboard of claim 1 wherein the polymer-foritified concrete is finished with a coating comprising an aqueous compounded latex emulsion and mineral particles.

8. The signboard unit of claim 1 wherein the polymer-foritifed concrete is made with an aqueous compounded latex emulsion containing a polymer having acrylate units.

9. The signboard unit of claim 1 wherein the polymer-fortified concrete contains fibrous reinforcement.

* * * * *